US009451682B2

(12) United States Patent
Hicks, IV

(10) Patent No.: US 9,451,682 B2
(45) Date of Patent: Sep. 20, 2016

(54) LIGHT BULB SYSTEM FOR PROVIDING A WALL OR LAMP FIXTURE SWITCH WITH DIMMER CAPABILITY

(71) Applicant: Roy Hicks, IV, Raleigh, NC (US)

(72) Inventor: Roy Hicks, IV, Raleigh, NC (US)

( * ) Notice: Subject to any disclaimer, the term of this patent is extended or adjusted under 35 U.S.C. 154(b) by 572 days.

(21) Appl. No.: 13/751,438

(22) Filed: Jan. 28, 2013

(65) Prior Publication Data

US 2014/0210376 A1 Jul. 31, 2014

(51) Int. Cl.
*H05B 37/02* (2006.01)
*H05B 39/08* (2006.01)

(52) U.S. Cl.
CPC ..... *H05B 39/08* (2013.01); *H05B 37/02* (2013.01)

(58) Field of Classification Search
CPC ..... H05B 37/02
USPC ..... 315/291, 294, 297, 307, 312
See application file for complete search history.

(56) References Cited

U.S. PATENT DOCUMENTS

| | | | | |
|---|---|---|---|---|
| 8,253,344 | B2 | 8/2012 | Guest et al. | |
| 9,055,629 | B2 * | 6/2015 | Chen | H05B 33/0845 |
| 2010/0141158 | A1 * | 6/2010 | Newman, Jr. | H05B 33/0845 315/182 |
| 2011/0187332 | A1 * | 8/2011 | Salvestrini | 323/234 |
| 2011/0204777 | A1 * | 8/2011 | Lenk | 315/32 |
| 2012/0230073 | A1 * | 9/2012 | Newman et al. | 363/126 |
| 2013/0076246 | A1 * | 3/2013 | Okawa et al. | 315/121 |

FOREIGN PATENT DOCUMENTS

| | | | |
|---|---|---|---|
| DE | 19814488 | A1 | 10/1999 |
| DE | 20309604 | U1 | 1/2004 |
| KR | 2004032344 | A | 4/2004 |

OTHER PUBLICATIONS

Flip-flops (electronics), Wikipedia, the free encyclopedia, http://en.wikipedia.org/wiki/Flip-flop_(electronics).
Dimmer, Wikipedia, the free encyclopedia, http://en.wikipedia.org/wiki/Dimmer.

* cited by examiner

*Primary Examiner* — Tung X Le
(74) *Attorney, Agent, or Firm* — James G. Passé; Passé Intellectual Property, LLC

(57) ABSTRACT

The invention relates to a dimming light bulb for retrofitting a ceiling or lamp fixture wherever a dimming function can be accessed from the regular light switch.

7 Claims, 3 Drawing Sheets

LIGHT BULB SYSTEM FOR PROVIDING A WALL OR LAMP FIXTURE SWITCH WITH DIMMER CAPABILITY

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to dimming a light bulb. In particular, it relates to a light bulb which allows a regular wall or lamp fixture switch to become a dimming light switch.

2. Description of Related Art

The standard incandescent light bulb and the new LED light bulbs, unlike most fluorescent light bulbs can be dimmed by controlling the current going to the bulb. Therefore, such bulbs can be utilized in situations where it is desirable to vary the light intensity in the room depending on the activity or desire to conserve energy. Some activities like detail work might need intense light while other activities like energy saving or a romantic evening dinner might allow for more subdued lighting.

Up to this point the adjustment of lighting has been handled in one way, though there are many variations. The basic concept is to replace the standard on/off switch (e.g. a wall light switch) with some form of variable current switch. A wall switch can be replaced by a rotating or dimming wall switch. More sophisticated wall switches involve digital electronic control of the current fed to the bulb. But in general the more current to the bulb, the brighter the bulb is. In some cases the on/off switch is left in place and some form of variable resistor switch placed in line requiring the on/off switch be turned on and then the resistor adjusted. One such attempt has been a light fixture with a built-in touch dimmer switch. Very impractical, however, for ceiling mounted light bulbs. When dealing with a ceiling mounted bulb, replacing the wall switch has been the only solution developed to date.

Replacing light switches is often hazardous, not practical for every fixture in the house, costly, and in rental housing situations, may even be prohibited. Use of three way bulbs in a three way lamp has dealt with some problems but they are hardly variable and once again useless in ceiling applications. A means for dimming the bulb without replacing the light switch or an existing fixture (i.e. making an on-off lamp become a dimmable lamp) would be an advance in lighting technology.

BRIEF SUMMARY OF THE INVENTION

The present invention adopts a new technology/dimmer strategy which does not require electrical wiring or switch changes to add a dimmer function to a light switch/light fixture assembly. The present invention associates a dimmer with the bulb, the dimmer operates by toggling the switch at different time delay intervals to obtain different levels of light intensity (programmed into the dimmer). One of the toggle delay times with the switch in the off position could then be used to set the dimmer to off or maximum lighting.

The easiest position is to mount the dimmer right on the bulb though any place in-line between the switch and bulb is usable.

Accordingly, in one embodiment the present invention is a system for converting an on/off light switch into a dimmer switch comprising a dimmable light bulb and associated dimmer in a circuit with the on/off light switch, the dimmer comprising:

a) a power supply circuit;
b) a power hold up for charging and storing power in response to a toggling of the on/off light switch;
c) a latching circuit; and
d) a timer for operating the latching circuit in response to timed toggles of the on/off switch.

In another embodiment the present invention is a lighting dimmer for use in a circuit between an on/off light switch and a dimmable light bulb comprising:

a) a power supply circuit;
b) a power hold up for charging and storing power in response to a toggling of the on/off light switch;
c) a latching circuit; and
d) a timer for operating the latching circuit in response to timed toggles of the on/off switch.

DETAILED DESCRIPTION OF THE INVENTION

Figure 1:
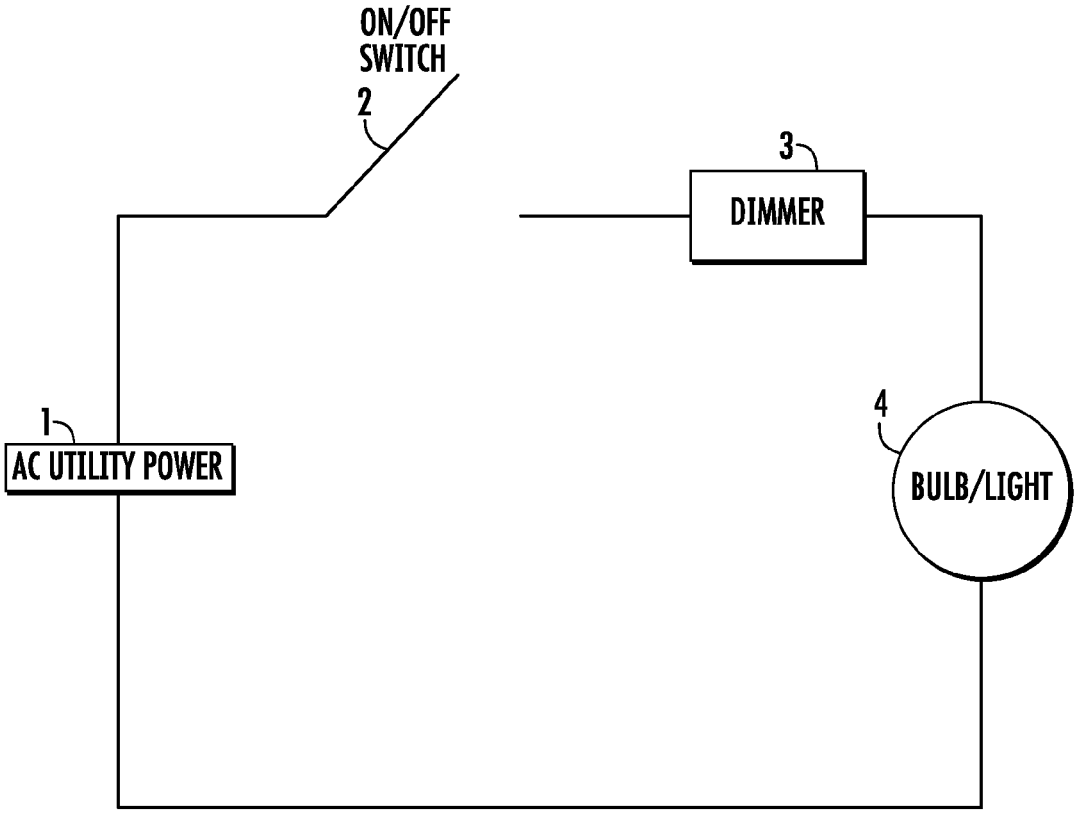
FIG. 1 is a diagram of the dimmer in a power/light bulb circuit.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein an "on/off light switch" refers to an AC current switching device that has two positions (on and off). In one embodiment the switch is a toggle electrical wall switch. As used herein a "dimmer switch" is an electrical switch which operates a light dimming function, i.e. it operates a dimmer. As used herein a "dimmer" refers to a device for placement in an AC lighting circuit for variably delivering current to a dimmable light bulb in order to vary the light output of the light bulb. The dimmer switch can have a single dimmable position or multiple dimmed positions or have an infinitely variable resistance for between full lighting power and off. It can be located on the light bulb or in the circuit between the on/off light switch and the light bulb or bulbs being dimmed. Since in one embodiment the dimmer has a DC circuit for powering the timer power hold up and latch circuit, an AC to DC converter is also part of the dimmer circuit.

As used herein a "dimmable light bulb" refers to any kind of light bulb which can have its light output varied by varying the resistance over the electric circuit supplying electricity to the bulb. Incandescent, LED and some fluorescents all have this capacity and such bulbs are known in the art.

As used herein a "power supply circuit" refers to an electrical supply (AC) that supplies AC electrical power to a light bulb or light bulb socket for lighting the light bulb. As used herein a "power holdup" is a device known in the art for charging and storing power from the power supply circuit in response to a toggling of the on/off light switch. As used herein a "latching circuit" is a circuit used to store a specific state or condition within the electronics. As used herein the "timer" is utilized to operate the latching circuit in response to timed toggles of the on/off switch. For example, a toggling of the on/off switch for 3 seconds would be code to dim the lights 50% or whatever is the present amount. The toggling could also be utilized to set the dim level in response to the toggling event. One skilled in the art armed with this invention could easily program the circuit to have multiple dimming positions as well as allow for the setting of the dimming positions utilizing only the light on/off switch.

Initially the utility provides electrical power to an electrical circuit of the bulb, the dimmer, and the switch. The light switch closes the circuit and energizes the dimmer and light bulb. The bulb is initially supplied full power for maximum light intensity. If a lower light intensity is desired, the on/off switch is toggled at different (set) time delay intervals to obtain different levels of light intensity. An extended toggle delay even in the switch off position will result in a reset of the dimmer to maximum light intensity. The times and dimmer levels can be present in the dimmer or the device can be utilized to set them as desired.

Now referring to the drawings, FIG. 1 is a block diagram showing the position of the dimmer in an electrical AC circuit. AC utility power 1 supplies AC power to an on/off switch 2. The switch provides AC power to dimmer 3 which in turn delivers power or lowers the power to dim light bulb 4.

Figure 2:
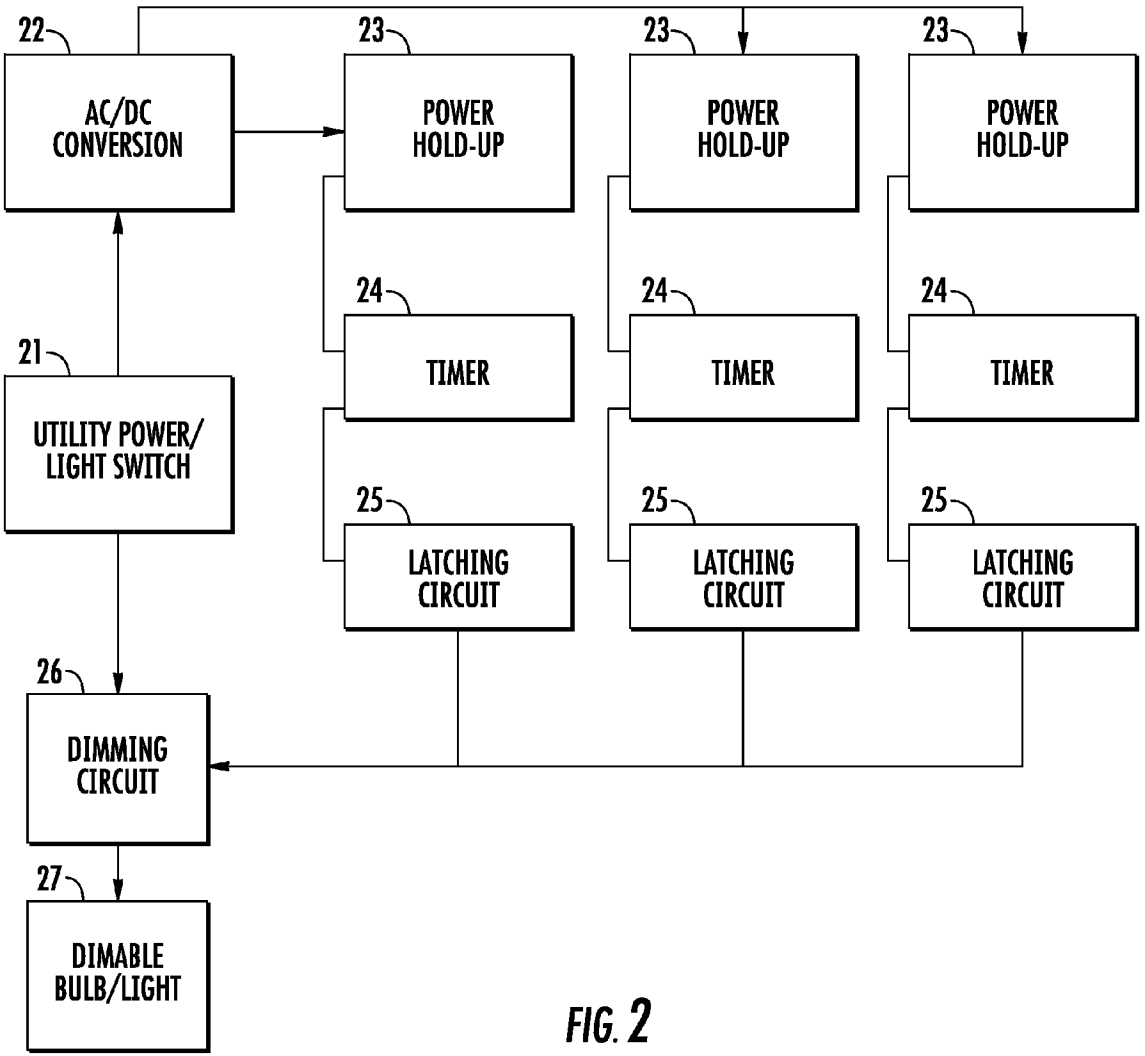
FIG. 2 is a block diagram of a dimmer system with several dimmer settings.

FIG. 2 is a block diagram breaking down the dimmer into the components of the dimmer of the present invention wherein there are three different dimmer positions represented by the three columns of power hold-up, timer and latching circuit. Utility power and light switch 21 powers AC/DC converter 22 which powers the three power hold-up 23, timer 24, and latching circuit 25 which provides information to a dimmer circuit 26 which actually provides controlled power to bulb 27 by receiving an AC power from the light switch.

Figure 3:
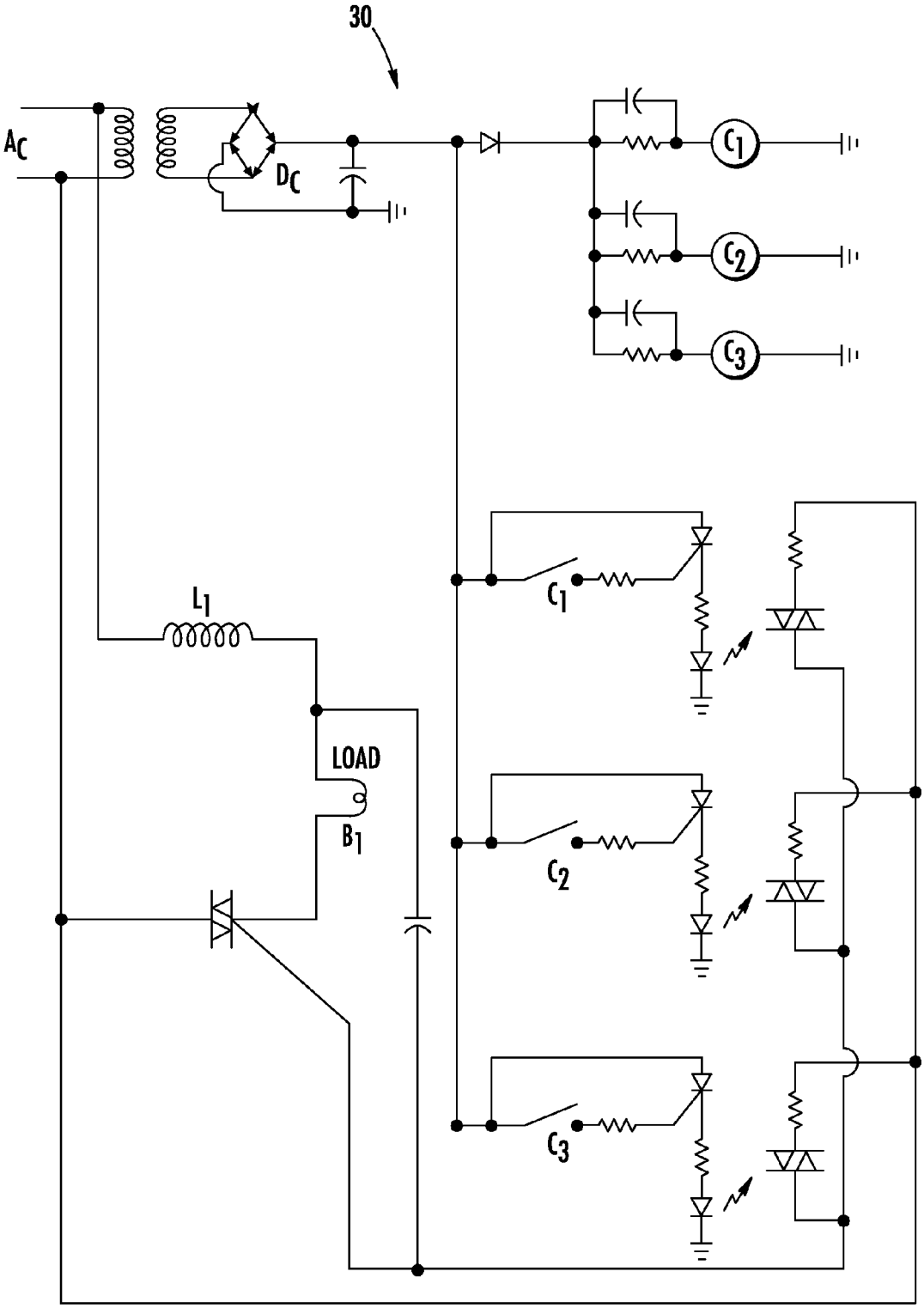
FIG. 3 is an exemplary circuit diagram of a three position dimmer, light bulb, light switch circuit.

FIG. 3 is an example of a circuit 30 which is an electrical diagram of the same device shown in block diagram in FIG. 2. One can see the three circuit's power and the like and this device combined with the lighting circuit provides dimmable lighting.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A system for utilizing a non-dimmable on/off light switch as a dimmer switch comprising:

a dimmable light bulb and an associated dimmer device separate from the non-dimmable on/off light switch in a lighting circuit, wherein the non-dimmable on/off light switch controls the lighting intensity of the system, the dimmer comprising:

a) a power supply circuit using line and neutral AC power connections to operate and control a dimming circuit;

b) one or more power hold up circuits for charging and storing power in response to a toggling of the on/off light switch;

c) a latching circuit for each of the one or more power hold ups;

d) a timer circuit for operating the latching circuit in response to timed toggles of the on/off switch; and e) the dimming circuit which is controlled by the one or more latching circuits and controls power to the lightbulb.

2. A system according to claim 1 wherein the light bulb is an incandescent, CFL or an LED type light bulb.

3. A system according to claim 1 wherein the dimmer is mounted on or attached to the light bulb.

4. The system according to claim 1 wherein there are a plurality of power hold ups.

5. A lighting dimmer for use in a circuit between a non-dimmable on/off light switch and a fixture for converting the power from the non-dimmable on/off light switch to dimmable power, wherein the non-dimmable on/off light switch controls the fixture circuit power comprising:

a) a power supply circuit using line and neutral AC power connections to operate and control a dimming circuit;

b) one or more power hold ups for charging and storing power in response to a toggling of the on/off light switch;

c) a latching circuit for each of the one or more power hold ups;

d) a timer for operating the latching circuit in response to timed toggles of the on/off switch; and e) the dimming circuit which is controlled by the one or more latching circuit and controls power to the fixture.

6. The lighting dimmer according to claim 5 wherein the dimmer is part of the lighting circuit.

7. The dimmer according to claim 5 wherein there are a plurality of power hold ups.

* * * * *